US007335047B2

(12) United States Patent
Bernat et al.

(10) Patent No.: US 7,335,047 B2
(45) Date of Patent: Feb. 26, 2008

(54) METALLIC CONNECTOR

(75) Inventors: Jean Francois Bernat, Sartrouville (FR); Jean-Merri de Vanssay, Paris (FR)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/685,697

(22) Filed: Mar. 13, 2007

(65) Prior Publication Data

US 2007/0232116 A1 Oct. 4, 2007

(30) Foreign Application Priority Data

Mar. 31, 2006 (DE) ..... 20 2006 005 177 U

(51) Int. Cl.
*H01R 13/627* (2006.01)

(52) U.S. Cl. ..... 439/350; 439/358; 439/610

(58) Field of Classification Search ..... 439/350–358, 439/610

See application file for complete search history.

(56) References Cited

U.S. PATENT DOCUMENTS 5,318,457 A 6/1994 Harting et al.
5,930,426 A * 7/1999 Harting et al. ..... 385/56
7,081,002 B2 7/2006 De Vanssay et al.
2004/0209509 A1* 10/2004 Okamura et al ..... 439/357
2006/0063415 A1* 3/2006 de Vanssay et al ..... 439/350

FOREIGN PATENT DOCUMENTS

DE 102 36 275 8/2002
DE 102 36 275 8/2004
DE 10 2004 046 259 9/2006

* cited by examiner

*Primary Examiner*—James Harvey
(74) *Attorney, Agent, or Firm*—Hayes Soloway P.C.

(57) ABSTRACT

The invention proposes a metallic push-pull connector for use in harsh and moist industrial environments that is provided with a sliding sleeve and features an interlocking device that causes the connector to be interlocked with a mating connector during the installation process, wherein the interlocking hooks of the interlocking device are levered out of snap-in depressions in the mating connector by means of a wedge-shaped slope when the sliding sleeve is pulled back.

6 Claims, 5 Drawing Sheets

METALLIC CONNECTOR

BACKGROUND OF THE INVENTION

1. Field of the Invention

The invention pertains to a metallic push-pull connector that is composed of a base body for accommodating the connector insert and a displaceable sleeve that encompasses the base body and can be interlocked with a mating connector.

A connector of this type is required for providing a plug-type connection that is subjected to high mechanical stresses and intended for use under harsh environmental conditions with a device that can be easily connected and interlocked.

2. Description of the Related Art

DE 102 36 275 B3 describes an interlocking device for a plug-type connection, in which integral locking means arranged on the connector housing engage into corresponding snap-in depressions in the mating connector, wherein the interlocked connection can be disengaged by means of the axially displaceable sliding sleeve.

However, known push-pull connectors of this type are not suitable for use in harsh industrial environments.

SUMMARY OF THE INVENTION

The invention therefore is based in objective of designing a metallic push-pull connector of the initially cited type in such a way that it features an interlocking and disengaging device in the form of a simple axial sliding means that simultaneously ensures a very tight seal against harsher environmental conditions.

This objective is attained in that at least one locking plate with an angled bar is arranged on the base body of the connector, in that an integral wedge pointing into the sleeve is arranged on the mating side of the sleeve, in that the angled bar of the locking plate lies on a slope of the wedge, and in that the bar runs on the slope of the wedge when the sleeve is pulled back, with an interlocking hook provided on the locking plate of a connector that is connected to a mating connector being levered out of a depression in the mating connector during this process.

The advantages attained with the invention can be seen, in particular, in that a plug-type connection according to the push-pull principle can be rendered suitable for use under harsher environmental conditions with a relatively simple axially acting interlocking device.

In this respect, it should be noted that known interlockable push-pull connectors frequently feature openings, outwardly acting interlocking means and the like and therefore are unacceptable for use in industrial environments.

One particular advantage is that a metallic push-pull connector of small dimensions up to IP 67 which is able to withstand high mechanical stresses can be realized in a "submersible" fashion and separated from a mating connector with a short axial displacement (approximately 2 mm).

To this end, a connector insert is fixed in a rectangularly shaped housing, e.g., a die cast zinc housing that is encompassed by a corresponding sliding sleeve.

Two locking plates featuring interlocking hooks are respectively held opposite of one another between the sliding sleeve and the base body.

A ring seal held on the base body in a corresponding groove is pushed into a socket of the mating connector during the mating process and seals the arrangement against moisture. The sliding sleeve is simultaneously pushed onto the outer side of the mating connector socket with the interlocking device of the connector.

It is also advantageous that the connector socket is provided with snap-in depressions, into which the interlocking hooks engage.

When the sliding sleeve is pulled back, the interlocking hooks are advantageously lifted out of the snap-in depressions and the connector can be separated from the mating connector.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
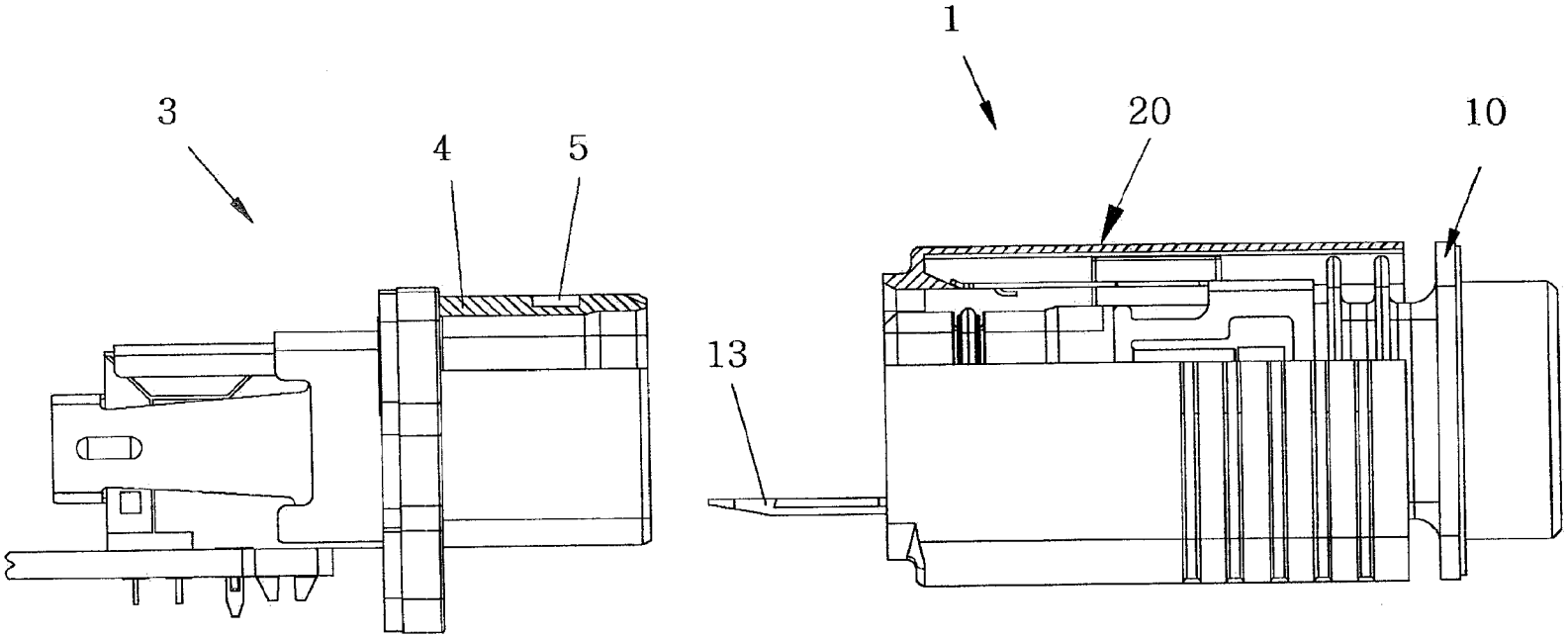
FIG. 1 a partially sectioned isometric representation of a connector and a mating connector.

FIG. 1 shows a so-called push-pull connector 1 that can be connected to a mating connector 3 in the separated state. In this case, the mating connector 3 is provided with a housing that can be flanged onto a housing wall and features a socket 4, onto which the connector 1 can be pushed.

Figure 2A:
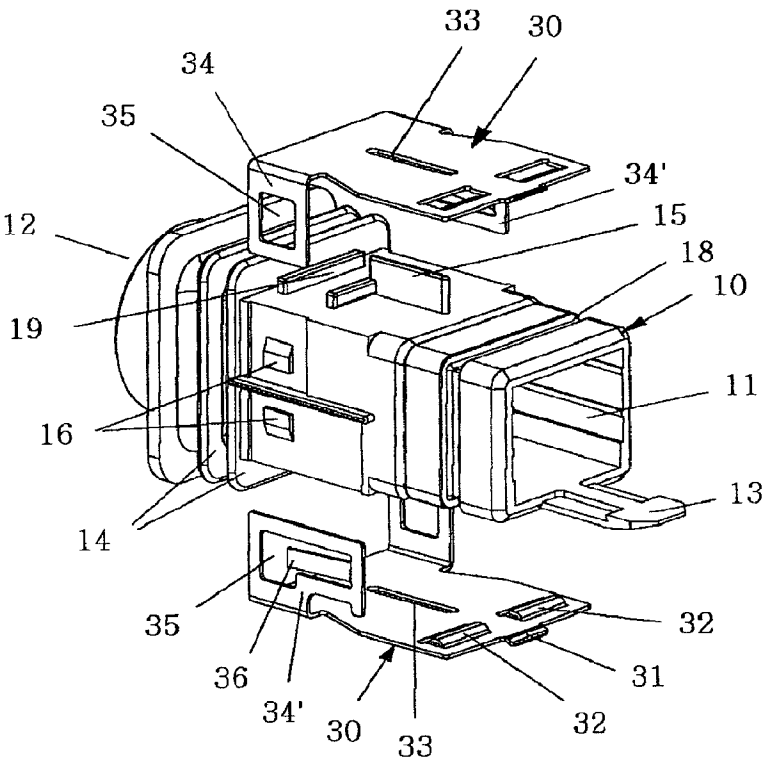
FIG. 2*a* a perspective representation of the base housing of a connector with locking plates that are spaced apart from one another.

FIG. 2*a* shows part of the metallic connector 1 with a base body 10 and two locking plates 30 in the separated state.

The base body 10 is essentially realized in the form of a sleeve-shaped die cast part with a cable connection side 12 and a mating side 11 that serves for accommodating the not-shown connector insert.

An integral locking tab 13 is arranged on the mating side 11 of the base body 10, wherein this locking tab serves for interlocking the not-shown connector insert in the base body 10 and releases the connector insert when it is bent away from the base body.

The cable connection side 12 features a rear wall with an opening for a corresponding electric cable, as well as two transverse ribs 14, on which a sliding sleeve 20 is guided in a displaceable fashion such that it is uniformly spaced apart from the base body 10.

Locking plates 30 made of steel sheets are arranged above and underneath the base body and essentially realized in the form of flat sheets that feature two oppositely arranged locking elements 34, 34' that are angled by approximately 90° and contain snap-in openings 35.

The locking plate 30 furthermore features a longitudinal slit 33 that extends toward the displacement axis of the connector.

In addition, the locking plate 30 is provided with two interlocking hooks 32 that are relieved on three sides longitudinally to the base body axis and bent opposite to the direction of displacement, namely underneath and parallel to the sheet disk.

On its front side, the locking plate features a bar 31 that is bent outward by approximately 30° and the function of which is discussed further below.

One respective web 15 that engages into the longitudinal slit 33 is respectively provided on the base body 10 in order to hold the two identical locking plates 30, wherein two locking tabs 16 are provided on the lateral surfaces of the base body and engage into the snap-in openings 35 provided in the angled locking elements 34, 34'.

Furthermore, integral spacers 19 are provided on the base body transverse to the web 15, namely in the direction of the transverse ribs 14, wherein said spacers hold the locking plate 30 at a certain minimum distance from the base body.

Figure 3:
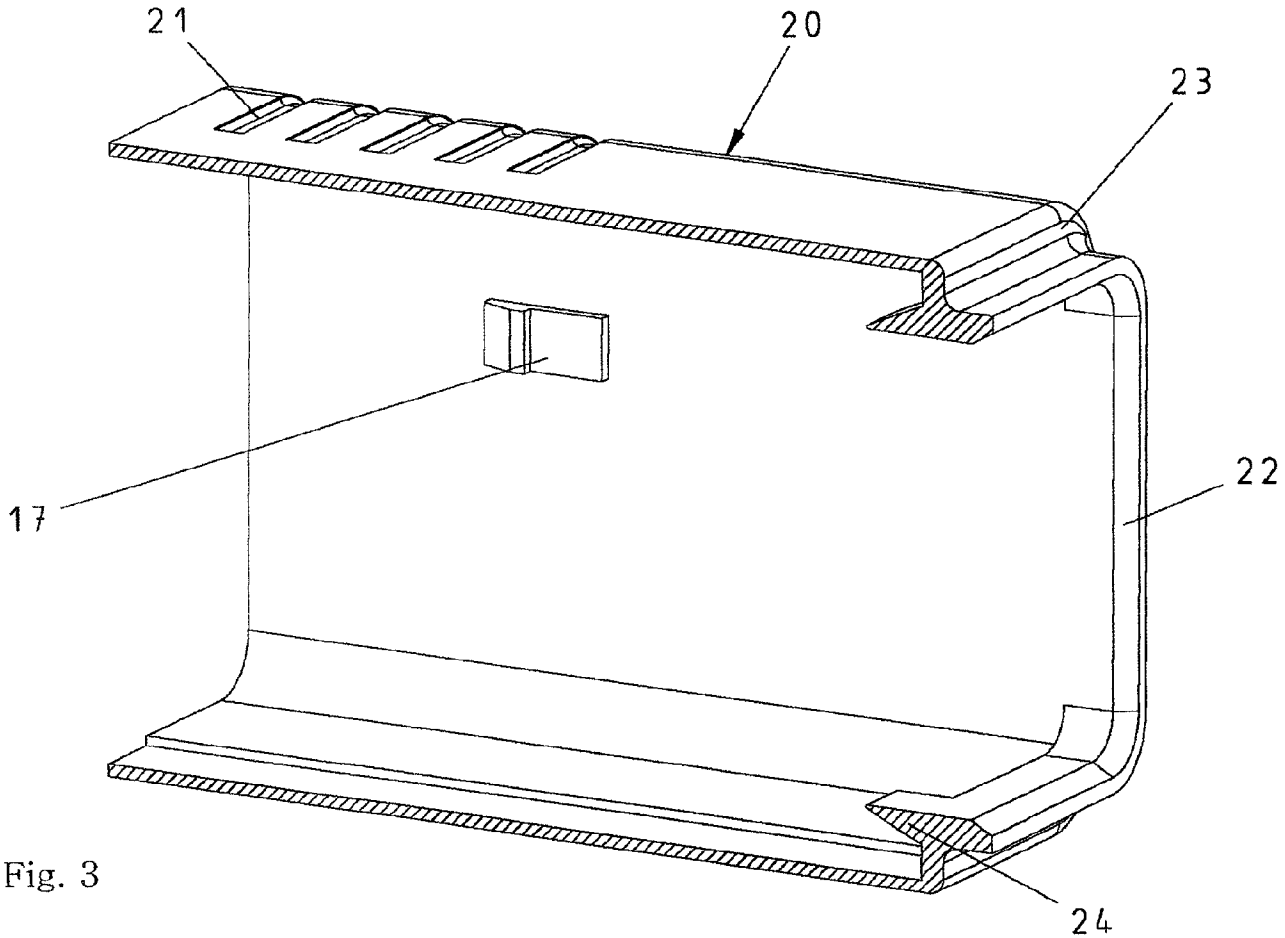
FIG. 3 a sectioned perspective representation of a sliding sleeve.

The sliding sleeve 20 that is illustrated in the form of a longitudinal section in FIG. 3 represents a nearly square sleeve body and features a collar 22 on the mating side, wherein said collar is realized in the form of an elevated structure 23 of the sleeve body on two opposite side walls.

A wedge 24 pointing into the interior of the sliding sleeve is arranged about centrally on or in the collar 22, namely such that the tip of the wedge points into the sleeve and the slope 25 of the wedge extends toward the outer wall in the direction of the collar—i.e., opposite to the mating direction.

In addition, several ribs 21 are provided on the outer surface of the sleeve transverse to the direction of displacement in order to simplify the displacement of the sleeve 20 on the base body 10.

Figure 2B:
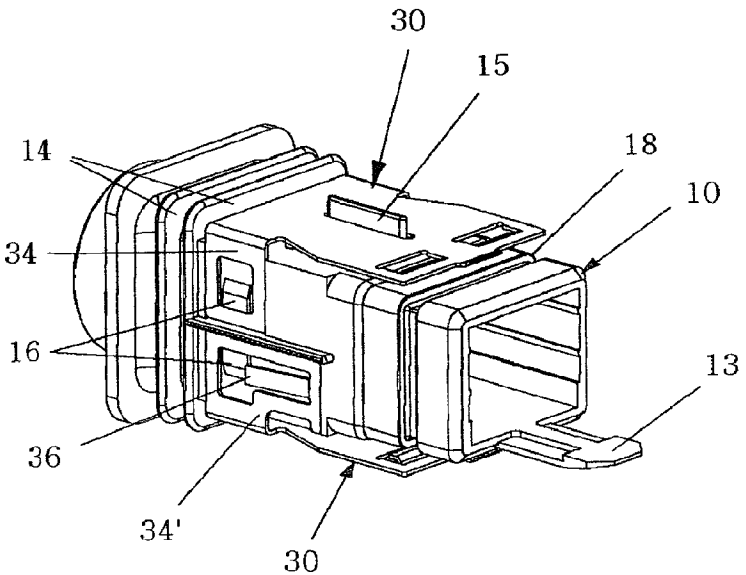
FIG. 2*b* a perspective representation in which the locking plates are mounted on the base housing.

During the installation of the connector, the two locking plates 38 are initially interlocked on the base body 10 as shown in FIG. 2*b*. The sliding sleeve 20 is subsequently pushed onto the base body from the mating direction 11. According to the sectional representation shown in FIG. 3, an interlocking hook 17 is integrally arranged in the interior of the sleeve 20 such that the springable interlocking hook 36 that laterally protrudes from the angled locking elements 34, 34' engages thereon.

Consequently, the sliding sleeve 20 is held on the base body 10 in a captive fashion and can still be axially displaced by a certain distance.

During the installation process, the respective inwardly pointing wedge 24 is simultaneously displaced on the collar 22 of the sliding sleeve 20 such that the slope 25 moves underneath the bar 31 of the locking plate 30 and the angled bar 31 lies on the slope 25 in any sliding position of the sliding sleeve.

Figure 4:
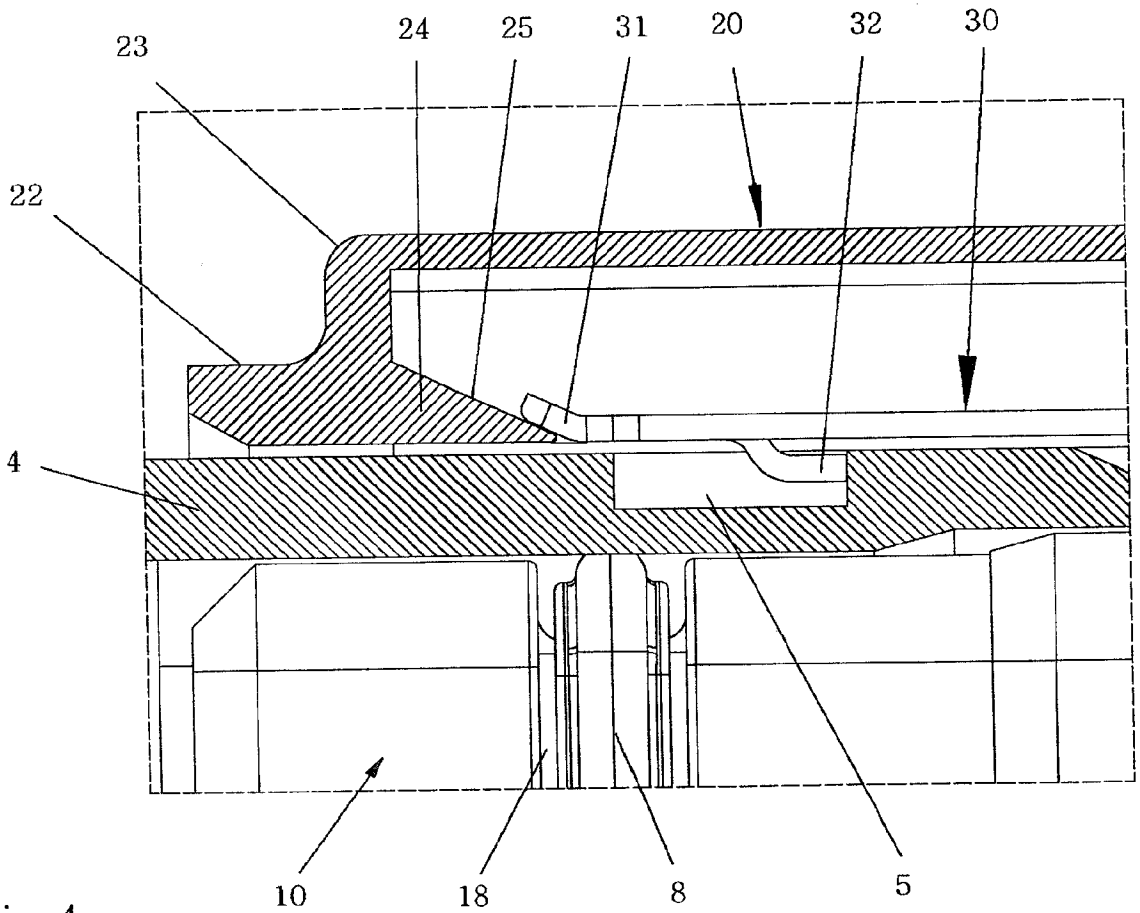
FIG. 4 a significantly enlarged representation of the interlocking mechanism, and FIG. 5 a partially sectioned perspective representation of the interlocking mechanism between the connector and a mating connector.

FIG. 4 shows a significantly enlarged and axially sectioned representation of the two connectors 1, 3 in the interlocked state, wherein the bar 31 obviously lies on the slope 25 of the wedge 24.

When the sliding sleeve 20 is pulled back opposite to the mating direction in order to disengage the two connectors, the slope 25 of the wedge 24 is pushed further and further underneath the angled bar 31 such that the interlocking hook 32 is levered out of the recess 5 in the socket 4 and the connector 1 can be separated from the mating connector 3.

It is advantageous to arrange a ring seal 8 near the recess 5 of the mating connector 3 such that the radially acting force of the ring seal 8 tends to press the socket 4 outward while the interlocking hook 32 safely engages into the recess 5.

Figure 5:
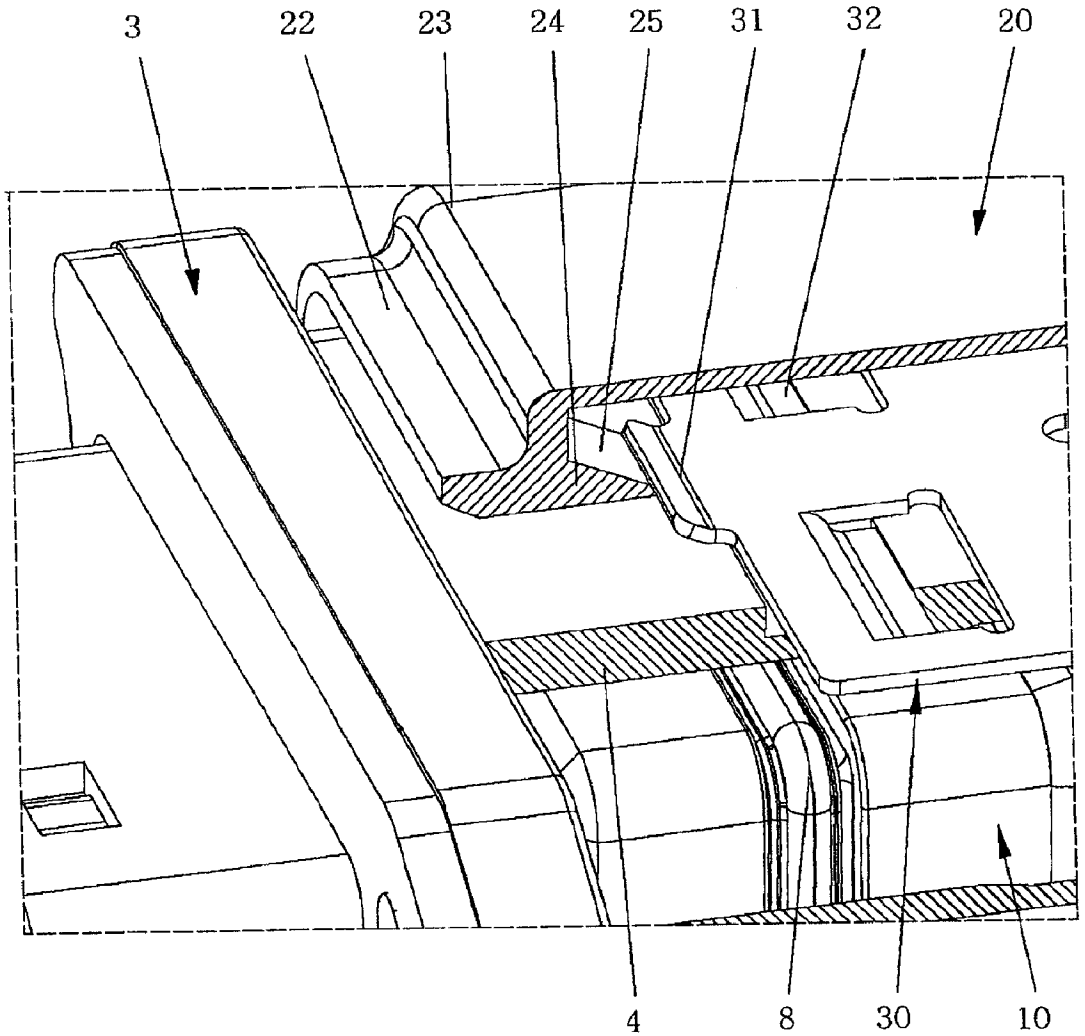

FIG. 5 shows a detail of the interlocking mechanism between the connector 1 and the mating connector 3 in the form of a partially sectioned perspective representation.

This figure clearly shows how the base body 10 of the connector 1 is inserted into the socket 4 of the mating connector 3 such that the ring seal 8 on the base body 10 presses against the inner wall of the socket 4 and definitively seals the arrangement against environmental influences while the collar 22 on the mating side fulfills an initial filtering function, e.g., as a dust filter, due to the covering effect of the sliding sleeve 20 that tightly adjoins the outer wall of the socket 4.

What is claimed is:

1. A metallic push-pull connector comprising of a base body for accommodating the connector insert and a displaceable sleeve that encompasses the base body and can be interlocked with a mating connector, wherein at least one locking plate with an angled bar is arranged on the base body of the connector, wherein an integral wedge pointing into the sleeve is arranged on the mating side of the sleeve, wherein the angled bar of the locking plate lies on a slope of the wedge, and wherein the bar runs on the slope of the wedge when the sleeve is pulled back, with an interlocking hook provided on the locking plate of a connector that is connected to a mating connector being levered out of a depression in the mating connector during this process.

2. The metallic push-pull connector according to claim 1, wherein the wedge pointing into the interior of the sleeve on the mating side is realized in the form of a block.

3. The metallic push-pull connector according to claim 1, wherein the locking plate features two angled locking elements with snap-in openings provided therein.

4. The metallic push-pull connector according to claim 1, wherein a springable interlocking hook is realized in one of the snap-in openings.

5. The metallic push-pull connector according to claim 1, wherein a ring seal to be inserted into a circumferential groove is arranged between the base body of the connector and the socket of the mating connector.

6. The metallic push-pull connector according to claim 1, wherein the sliding sleeve is displaceably held on the base body, however, in a captive fashion, by an integral internal interlocking hook and the interlocking hooks of the locking plates engaging thereon.

* * * * *